US010645971B2

(12) United States Patent
Zitzke

(10) Patent No.: US 10,645,971 B2
(45) Date of Patent: May 12, 2020

(54) ELECTRONIC SMOKING DEVICE

(71) Applicant: FONTEM HOLDINGS 1 B.V., Amsterdam (NL)

(72) Inventor: Roland Zitzke, Bienenbuttel (DE)

(73) Assignee: FONTEM HOLDINGS 1 B.V., Amsterdam (NL)

( * ) Notice: Subject to any disclaimer, the term of this patent is extended or adjusted under 35 U.S.C. 154(b) by 0 days.

(21) Appl. No.: 15/123,045

(22) PCT Filed: Feb. 27, 2015

(86) PCT No.: PCT/EP2015/000460
§ 371 (c)(1),
(2) Date: Sep. 1, 2016

(87) PCT Pub. No.: WO2015/131991
PCT Pub. Date: Sep. 11, 2015

(65) Prior Publication Data

US 2017/0079329 A1 Mar. 23, 2017

(30) Foreign Application Priority Data

Mar. 3, 2014 (EP) ..... 14000757

(51) Int. Cl.
*A24F 47/00* (2020.01)
*H05B 1/02* (2006.01)

(52) U.S. Cl.
CPC ..... *A24F 47/008* (2013.01); *H05B 1/0225* (2013.01); *H05B 1/0244* (2013.01)

(58) Field of Classification Search
CPC ..... A24F 47/008
(Continued)

(56) References Cited

U.S. PATENT DOCUMENTS 5,954,979 A * 9/1999 Counts ..... A24F 47/008 131/194
6,040,560 A * 3/2000 Fleischhauer ..... A24F 47/008 128/202.21

(Continued)

FOREIGN PATENT DOCUMENTS

CN 103415222 A 11/2013
EP 2443946 A 4/2012
WO 9817130 4/1998

OTHER PUBLICATIONS

European Patent Office, "Search Report and Written Opinion", for EP14000757, dated Aug. 28, 2014, 4 pgs.

(Continued)

*Primary Examiner* — Abdullah A Riyami
*Assistant Examiner* — Nader J Alhawamdeh
(74) *Attorney, Agent, or Firm* — Perkins Coie LLP; Kenneth H. Ohriner

(57) ABSTRACT

An electronic smoking (1) device comprises a housing (2), control electronics (14) and a puff detector (18). The housing (2) accommodates a battery (10) as an electric power source powering an electrically heatable atomizer (20) comprising an electric heater (22) and adapted to atomize a liquid supplied from a reservoir (6) to provide an aerosol exiting from the atomizer (20). The control electronics (14) controls the heater (22) of the atomizer (20) and is adapted to operate the heater (22) in at least two predetermined modes. The puff detector (18) indicates an aerosol inhaling puff to the control electronics (14). The control electronics (14) selects a specific mode for operating the heater (22) via a control signal initiated by the puff detector (18).

18 Claims, 1 Drawing Sheet

Figure 1:
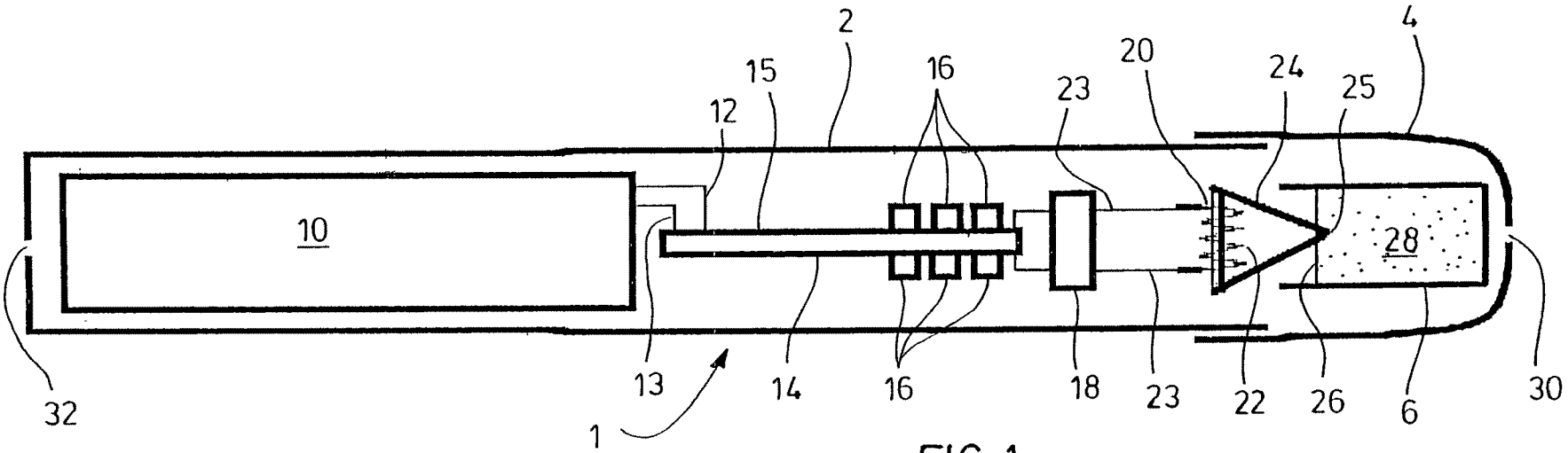

(58) Field of Classification Search
USPC ..... 439/328
See application file for complete search history.

(56) References Cited

U.S. PATENT DOCUMENTS 8,499,766 B1 8/2013 Newton et al.
8,550,069 B2 * 10/2013 Alelov ..... A61M 11/005 128/202.21
2011/0036346 A1 * 2/2011 Cohen ..... A61M 15/0065 128/200.14
2011/0265806 A1 * 11/2011 Alarcon ..... A24F 47/00 131/273
2011/0304282 A1 * 12/2011 Li ..... A24F 47/008 315/362
2013/0037041 A1 * 2/2013 Worm ..... A24F 47/008 131/329
2013/0104916 A1 * 5/2013 Bellinger ..... A61M 11/041 131/328
2013/0213419 A1 * 8/2013 Tucker ..... A24F 47/008 131/328
2013/0319440 A1 12/2013 Capuano
2013/0333711 A1 12/2013 Liu
2013/0340779 A1 12/2013 Liu
2014/0261408 A1 * 9/2014 DePiano ..... A24F 47/008 128/202.21
2014/0261489 A1 * 9/2014 Cadieux ..... A24F 47/008 131/328
2015/0216236 A1 * 8/2015 Bless ..... B23K 26/20 131/328
2016/0213066 A1 * 7/2016 Zitzke ..... A24F 47/008

OTHER PUBLICATIONS

European Patent Office, "Search Report and Written Opinion", for PCT/EP2015/000460, dated Jun. 15, 2015, 7 pgs.
State Intellectual Property Office, First Office Action in Chinese Application No. 201580014554.X; dated Sep. 5, 2018; 25 pages.
Taiwan Patent Office, Office Action for Taiwan Patent Application No. 104106516; dated Oct. 25, 2018; 11 pages.

* cited by examiner

ELECTRONIC SMOKING DEVICE

The invention relates to an electronic smoking device.

An electronic smoking device, e.g. designed as an electronic cigarette, comprises a housing accommodating an electric power source (usually a battery or a rechargeable battery), an electrically heatable atomizer including an electric heater adapted to atomize a liquid supplied from a reservoir (usually a capsule) in order to provide an aerosol exiting from the atomizer, and control electronics which controls activation of the heater of the atomizer. A puff detector is provided within the electronic smoking device which detects a user puffing on the device (e.g., by sensing an under-pressure or an air flow pattern through the device) and indicates or signals the puff to the control electronics. When a puff is indicated to the control electronics, the heater in the atomizer is powered, which causes the creation of aerosol. Here and in the following, the action of the atomizer is called "atomize" and the related product is called "aerosol", irrespective of its composition, which might include gaseous and smoke constituents.

EP 2 443 946 A1 discloses an electronic cigarette and a capsule containing a liquid to be atomized by an atomizer. The capsule comprises a shell which is sealed at one end by a puncturable membrane. To mount the capsule to the electronic cigarette, the capsule is inserted into a soft sleeve mouthpiece and attached to the end of a tube accommodating the atomizer. When mounting, a spike provided at the end of a metal wick pierces the membrane, and the liquid of the capsule is guided by the wick to the atomizer. When the atomizer is activated, an aerosol is generated and the aerosol passes through some ducts provided at the exterior surface of the capsule to reach an end opening where it can be inhaled by the user via the mouthpiece.

The natural interaction between a user and an electronic smoking device is puffing on the device. As described above, in an electronic smoking device, the device produces an aerosol in direct response to puffing on the device.

It is known to provide additional user interface elements on electronic smoking devices. Such interface elements are commonly represented by additional sliders, switches, buttons or knobs on the device, and they can be used, e.g., to adjust the strength or intensity of an aerosol created in response to a puff. However, such additional user interface elements complicate the operation of an electronic smoking device and may even result in the generation of undesirable kinds of aerosols, e.g. when the operation is faulty or user inputs are incompatible, resulting in a heater being over activated.

In contrast, the smoker of a conventional cigarette has several options to control the behaviour of the cigarette, which are commonly understood and applied by the smoker in a natural way. For example, more frequent inhalation and stronger puffs result in more and stronger smoke being inhaled. In this case, the cigarette will last shorter time than if being smoked gently, i.e. with longer breaks between the puffs and with shorter inhalations.

The object of the invention is to provide an electronic smoking device which presents an improved functionality and which nevertheless can be controlled by a user in an intuitive way, without the need for additional user interface elements.

This object is achieved by an electronic smoking device comprising the features of claim 1. Advantageous embodiments of the invention follow from the dependent claims.

Electronic smoking devices to which the claimed invention can be applied comprise a housing, which accommodates a battery as an electric power source powering an electrically heatable atomizer. The atomizer comprises an electric heater and is able to atomize a liquid supplied from a reservoir to create an aerosol exiting from the atomizer. The electronic smoking devices also comprise control electronics and a puff detector. The puff detector is an inhalation sensor which is responsive to the detection of the variation of airflow within the device which is representative of a user sucking on the device to initiate a control signal to the control electronics. The control electronics are then adapted to respond to this control signal by activating the heater of the atomizer to generate an aerosol which is inhaled by the user.

According to the invention, the control electronics are adapted to operate the heater of the atomizer in two or more predetermined modes, e.g. a "low" mode in which the atomizer generates a predetermined small amount of aerosol per puff and a "high" mode in which the atomizer generates a predetermined large amount of aerosol per puff. A specific mode for operating the heater is selected by the control electronics on the basis of control signals initiated by the puff detector. Thus a user can select or switch to a specific mode of operation by interacting with the device such that the puff detector is actuated in a particular way which then causes the puff detector to send a control signal to the control electronics, which is recognised by the control electronics as a mode change request.

In other words, mode selection is performed simply by applying sucking on the device in a certain way so that there is no need for extra user interface elements like those mentioned above. This is convenient to the user and greatly facilitates the handling of the electronic smoking device. Since the control electronics are adapted to operate the heater of the atomizer in predetermined modes, these modes can be designed in a co-ordinated way avoiding malfunction.

In some embodiments the control electronics may be adapted to measure the time interval between two subsequent actuations of the puff detector and to interpret the corresponding actuations of the puff detector as a control signal initiated by the puff detector for selection of a specific mode, if the measured value for the time interval is within a predetermined range. For example, if a user wants to switch to a "high" mode and the user may be required to suck twice at the mouthpiece of the electronic smoking device within a relatively short time interval. In such an embodiment a timer in the control electronics may be started upon the first sucking event and stopped upon the second sucking event. If the time interval between both events is smaller than a preselected value, the second sucking event is not interpreted as an additional aerosol-inhaling puff but as a mode selection demand. In this example, the higher sucking rate of the user resembles the typical behaviour when smoking a conventional cigarette in a more intense manner.

Alternatively, the control electronics could be adapted to measure the duration of an actuation of the puff detector and to interpret the corresponding actuation of the puff detector as a control signal initiated by the puff detector for selection of a specific mode, if the measured value for the duration is within a predetermined range. For example, if the electronic smoking device were to be in a "low" mode and the user was detected taking an unusual long puff, the control electronics could firstly cause the atomiser to generate a certain volume of aerosol and then, after realising that the duration of the user's puff had exceeded a predetermined value, switch the mode of operation for the atomizer to a "high" mode.

Equally, if a user were to be detected taking a very short durations puff when the device was in a "high" mode, the control electronics might utilise that to initiate a switch to a "low" mode.

From the above it will be apparent that there are many options for assigning certain signals initiated via the puff detector to certain predetermined modes for operating the heater of the atomizer.

In some embodiments, the control electronics may be adapted to select a specific mode different from the previously used mode if the measured value for the time interval or duration, respectively, is smaller than a predetermined threshold value, and to maintain the previously used mode if the measured value is greater than the threshold value. In this case, the user would suck on the device rapidly in a way which was detected by the puff detector in order to signal to the control electronics that a change of mode is desired. On the other hand, if the puff detector detects a user is operating the device in the usual, relatively slow manner, this can be interpreted by the control electronics as a demand for ordinary aerosol delivery, and the mode is not changed. To this end, the control electronics can be adapted to interpret the latest actuation of the puff detector as a signal to indicate an aerosol inhaling puff, if the measured value for the time interval or duration, respectively, exceeds a predetermined threshold value.

In some embodiments, the control electronics may be adapted to indicate the selection of a specific mode different from the previously used mode to a user by an externally detectable acknowledgment signal. In this way, the user gets a feedback upon selection of a new mode in order to be sure that the user command, transmitted via the puff detector, has been recognised by the control electronics. The acknowledgement signal may be, e.g., an optical signal (e.g. a flash of an LED) or an acoustic signal (e.g. a beep sound) or, less noticeable to the user's environment, a vibration.

Puff detectors in conventional electronic cigarettes are ordinarily arranged to respond to a single physical parameter or change of that parameter, e.g. an under-pressure or vacuum. In embodiments of the present invention a puff detector may be provided which is able distinguish between different qualities of a physical parameter and to transmit corresponding signals to the control electronics.

Thus for example in some embodiments, the puff detector may be able to detect an over-pressure and to initiate a control signal upon detection of an over-pressure (which would be different from the usual under-pressure or aerosol inhaling signal). In response to that control signal, the control electronics would then selects a specific mode. In such an embodiment, the user would blow into the mouthpiece of the electronic smoking device in order to indicate to the control electronics request for a change of mode. If a user inhales at the mouthpiece in the usual manner, the puff detector would merely transmit its normal signals to indicate to the control electronics to initiate an aerosol inhaling puff in accordance with the device's current mode of operation. In this way, the user's actions for changing the mode and for normal operation of the electronic smoking device would be clearly different.

In a more elaborate device, the control electronics may be adapted to store signals initiated by the puff detector to create a history of puff detector signals. The control electronics could then consider this history when selecting a specific mode. For example, a calm user may tend to smoke more slowly, having longer breaks between individual puffs. After analysing the history of puff detector signals resulting from such a behaviour, the control electronics could re-adjust the parameters of the predetermined modes, e.g. in order to better adapt a mode to the user or in order to better distinguish between the puff detector signals for aerosol demand and mode selection.

Predetermined modes may be directed to provide, e.g., a certain (more or less precisely defined) total amount of aerosol per puff or a certain (more or less precisely defined) amount of aerosol per time unit. For example, one of the predetermined modes may be directed to provide less aerosol during a puff than another one of the predetermined modes is directed to.

If the control electronics are adapted to measure the time lapsed after the latest puff, it may transfer the electronic smoking device into a dormant state, if this time exceeds a predetermined level. That means that the electronic smoking device recognises when the user stops smoking so that the heating power for the atomizer can be shut down, which saves energy.

In the electronic smoking device according to the invention, components like the housing, the battery, the atomizer, the puff detector (as far as it is not able to detect over-pressure), and the liquid reservoir may be designed as known in the art. This even holds for the hardware or major parts of the hardware of the control electronics. As explained above, however, the control electronics preferably comprises a timer. Moreover, the programs stored in and executed by the control electronics (firmware, software) are adapted to the invention.

Components like the battery, the atomizer and/or the reservoir may be parts of the electronic smoking device. It is conceivable as well that they are not part thereof, in particular if the electronic smoking device has a modular design or if articles like the reservoir are sold separately, e.g. as capsules or cartridges.

In the following, the invention is further explained by means of embodiments. The drawings show in FIG. 1 a schematic longitudinal section of an embodiment of the electronic smoking device according to the invention and FIG. 2 a schematic block diagram illustrating mode selection by means of the puff detector and the control electronics of the electronic smoking device.

FIG. 1 illustrates an embodiment of an electronic smoking device 1 in a schematic longitudinal section.

The electronic smoking device 1 comprises a cylinder-like housing 2 and a mouthpiece 4, which is designed as a detachable cap. Taking off the mouthpiece 4 provides access to a replaceable capsule 6, which serves as a reservoir for a liquid.

The housing 2 accommodates a battery 10. In the embodiment, the battery 10 is designed as a re-chargeable lithium ion battery and may include its own circuitry. The battery 10 is connected, via leads 12 and 13, to control electronics 14, which includes integrated circuits mounted on a printed circuit board 15. The printed circuit board 15 also supports a plurality of light-emitting diodes (LEDs) 16, which are assembled behind respective windows provided in the housing 2 and indicate the current status of the electronic smoking device 1.

A puff detector 18 is connected to the control electronics 14. In the embodiment, the puff detector 18 is designed as an inhalation sensor, which detects the vacuum generated inside the housing 2 when a user inhales at the mouthpiece 4.

An atomizer 20 comprises a heater 22 connected via leads 23 to the control electronics 14. The heater 22 includes a heating wire mounted at a ceramics shell (not shown is in the Figures), which also supports a wick device 24 made of braided metal or sponge-like metal material. A piercing tip 25 at the distant end of the wick device 24 is able to penetrate a membrane 26 used for sealing the capsule 6 so that liquid 28 contained in the capsule 6 can be guided out of the capsule 6 and through the wick device 24 to the area of the heater 22.

At its free end, the mouthpiece 4 comprises an inhalation aperture 30. At the opposite end of the electronic smoking device 1, a charging port 32 is provided which permits re-charging of the battery 10, e.g. via a USB port.

To use the electronic smoking device 1, a consumer inserts a fresh capsule 6 so that its membrane 26 is pierced and liquid is supplied from the capsule 6 via the wick device 24 to the area of the heater 22. When the consumer inhales at the inhalation aperture 30, the puff detector 18 senses the resulting vacuum inside the housing 2 and indicates that to the control electronics 14. In response thereto, the heater 22 is powered so that its heating wire is able to atomize the liquid in its proximity in order to create an aerosol, which is inhaled by the consumer. In the embodiment, the heater 22 remains switched on for a predetermined period of time, which is given by a predetermined mode. This mode for operating the heater in the atomizer can be selected by the consumer (user) via the puff detector 18, as explained in the following.

The heater 22 may be provided in various other forms of direct heating and indirect heating of the liquid, each having advantages. In direct heating designs, the liquid directly contacts the heating element, which may be a wire coil, rod or other heater surface. In indirect heating designs, the liquid contacts a surface heated by a separate heating element, which does not come into direct contact with the liquid. Other types of atomizers or vaporizers may alternatively be used. Various ultrasonic atomizers are effective in creating vapour without heating. For example, an ultrasonic atomizer using a free-running Colpitts oscillator generates high frequency energy in to the range between 800 kHz and 2000 kHz driving a piezoelectric vibrator converting liquid into vapour. Atomizers having electrostatic, electromagnetic or pneumatic elements have also been proposed.

Figure 2:
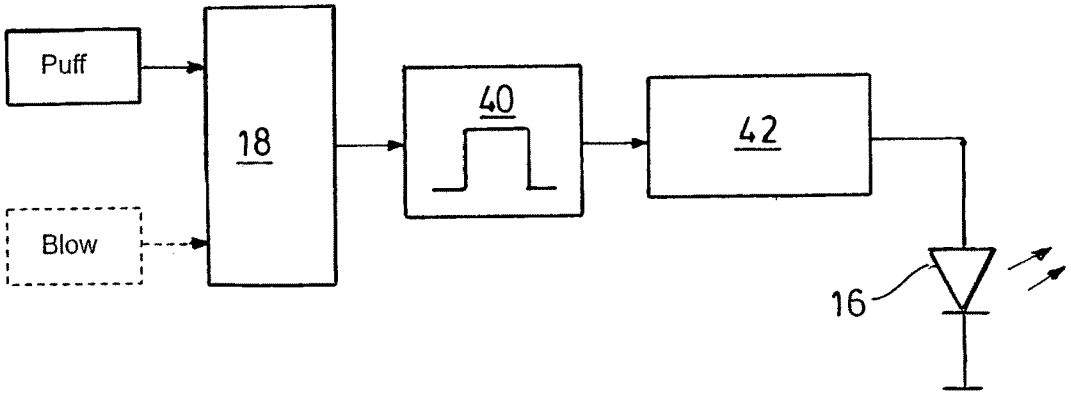

FIG. 2 illustrates the functional relationship for mode selection by means of a is schematic diagram.

The puff detector 18 is arranged in the airflow pathway within the housing 2. In the embodiment, the puff detector 18 senses an under-pressure (vacuum) in relation to the ambient air pressure. Such kind of sensor is already in common use in electronic cigarettes. The puff detector 18 may be an airflow sensor, such as a rocking vane sensor or a Hall element sensor. These may be used in place of the vacuum sensor, as in some designs, airflow is more easily and accurately measured in comparison to vacuum or pressure. Airflow sensors may also have faster response times. The sensor may be designed to allow airflow through or around the sensor, such as with a sensor having an annular shape. Diaphragm and MEMS sensors may similarly be used. Silica gel corrugated membrane sensors have also been proposed for this type of application. These and similar such sensors are available from Micro Pneumatic Logic, Pompano Beach Fla., USA and from Honeywell Microswitch, Freeport, Ill., USA.

Upon actuation of the puff detector 18, i.e. when the pressure drops, a control signal is transmitted to the control electronics 14. The control electronics 14 comprises a timer circuit 40 (preferably a gate timer), which can be a common component of control electronics in electronic cigarettes. The timer circuit 40 generates, from the control signal, a time marking. A controller 42 in the control electronics 14 is programmed to determine the time intervals elapsed between consecutive control signals from the puff detector 18. This is achieved by simply subtracting the time values of two consecutive time markings (readings). In this way, it is possible to obtain the time interval between two consecutive puffs. This time interval is compared with threshold values for, e.g., normal, short and long intervals. If it turns out that the time interval is in a predetermined range for normal intervals, this is interpreted as normal user activity and does not result in a change of mode. If, however, the time interval is in a predetermined range for short intervals or long intervals, this is interpreted as a user demand for selection of a different mode of operating the electronic smoking device. These predetermined ranges are stored in the control electronics 14, e.g. via firmware.

For example, normal smoking consists of puffs having a minimum puff duration and a typical pause between subsequent puffs, e.g. a minimum puff duration of 2 seconds and a minimum pause between puffs of 5 seconds. If the timer arrangement described above records a user's activity falling in these limits, it is assumed that no user command has been given except regular puffing. That means, the heater 22 of the atomizer 20 is activated upon puffing, and the mode of the electronic smoking device is not changed.

However, in the example, if the user takes only a short pause between puffs, then this will be considered as a command for selection of a different one of the predetermined modes, in this case a mode which delivers more aerosol per puff. In the embodiment, the provision of more aerosol is achieved by actuating the heater 22 of the atomizer 20 for a longer (predetermined) time interval per puff.

The user can be given a feedback to acknowledge the recognition of the mode change command. This can be an optical feedback of any kind, e.g. via the LEDs 16. In a more simple form, the atomizer does not produce aerosol on the second puff to indicate that the user command was understood. Other kinds of feedback, like a sound or a vibration, are conceivable as well.

Similarly, if the user takes a rather long pause between puffs, e.g. more than 20 seconds, this will be interpreted as a command for selection of another mode, i.e. a mode which delivers less aerosol per puff, which is achieved by activating the heater of the atomizer for a shorter time interval per puff.

So far, it was assumed that the beginning of each actuation of the puff detector 18 provides a time marking. However, it is also possible to create time markings via the duration of an individual puff so that, e.g., a very short puff may be interpreted as a command to select a different one of the predetermined modes.

Puff intervals of excessive duration, i.e. of more than one minute, may be ignored as this indicates that the user has simply stopped smoking for a while without any intent to provoke a user interaction.

Similarly, if the time lapsed after the latest puff exceeds a predetermined level, the control electronics 14 may transfer the electronic smoking device into a dormant state or switch it completely off in order to save energy.

In another embodiment, the puff detector is able to detect over-pressure, in addition to detecting under-pressure (vacuum), and to initiate a control signal indicating over-pressure upon detection of an over-pressure. In response to that control signal, the control electronics can select a specific predetermined mode. Thus, in such an embodiment, there is no need for analysing the timing sequence of the signals provided by the puff detector in order to find out whether a signal in question is an ordinary demand for an actuation of the atomizer to generate aerosol or whether that signal is a mode selection signal. On the other hand, the puff detector has to be more elaborate. For example, it may comprise a conventional puff detector for sensing under-pressure plus an additional subunit which is able to detect overpressure. As used here, the word puff means the user inhaling on the mouthpiece of the device, or blowing into the mouthpiece of the device.

In an embodiment including a puff detector operable to detect both under pressure and over pressure, the user blows into the electronic smoking device in order to change the mode or to select a specific mode. An analysis of the timing of the blowing events may nevertheless be helpful in order to assign to the blowing events a plurality of options for different modes. When the user inhales at the mouthpiece of the electronic smoking device, an under-pressure is sensed, which causes the control electronics to activate the heater of the atomizer for providing aerosol.

Although in the above description reference has been made to an electronic smoking device operating in a "high" and a "low" mode, it will be appreciated that in embodiments of the present invention more than two modes might be available.

Thus for example, in some embodiments, the atomizer may be operated at a greater number of levels of activation (e.g. "low", "medium" and "high"). In some embodiments an even greater number of activation levels might be provided with a user being able to set the desired activation level by utilizing the device in a way which was detectable by a puff detector 18.

It will be appreciated that the selection of a mode of operation may be more complex than simply setting a level of activation for the heater 22 of an atomizer 20.

Thus for example, the interaction with the puff detector 18, could cause the device to enter a mode where the activation of a heater 18 was to be set on the basis of the duration of one or more immediately previous inhalations. Such a system could better mimic the variation in heating and smoke generation of a conventional cigarette.

So for example, in such a mode, the heating power of the atomizer 20 could be set based on the duration of the latest detected inhalations within a set time period with the power increasing when the puff detector 18 has determined that a user has been sucking on the device for a higher proportion of the most recent period of time under consideration.

From the foregoing, it is evident that the selection of two or more than two predetermined modes for operating the electronic smoking device can be encoded by control signals initiated by the puff detector in many different ways. In all cases, the user does not have to press any buttons, but it is sufficient just to interact via the mouthpiece of the electronic smoking device in order to change or select a mode.

The invention claimed is:

1. An electronic smoking device, comprising:

a puff detector operable to detect a user sucking on or blowing into the device;

an atomizer comprising a heater operable to create an aerosol for inhalation by a user by atomizing a liquid supplied from a reservoir; and control electronics responsive to the puff detector detecting a user sucking on or blowing into the device to activate the atomizer to atomize a liquid supplied from a reservoir to create an aerosol for inhalation, characterised in that:

the control electronics are adapted to detect a manner of activation of the puff detector, responsive to the puff detector detecting a user sucking on or blowing into the device, and to select, on the basis of the detected manner of the activation of the puff detector, a mode of operation from a plurality of modes of operation, and to use the selected mode of operation to activate the heater.

2. The electronic smoking device according to claim 1, characterised in that the control electronics are configured to measure the time interval between two subsequent activations of the puff detector and interpret the corresponding activations of the puff detector as a control signal initiated by the puff detector for selection of a specific mode of operation, if the measured value for the time interval is within a predetermined range.

3. The electronic smoking device according to claim 1, characterised in that the control electronics are configured to measure the duration of an activation of the puff detector and to interpret the corresponding activation of the puff detector as a control signal initiated by the puff detector for selection of a specific mode of operation, if the measured value for the duration is within a predetermined range.

4. The electronic smoking device according to claim 2, wherein the control electronics are configured to select an alternative mode of operation to a previously used mode of operation if the measured value for the time interval or duration, respectively, is smaller than a predetermined threshold value, and to maintain the previously used mode if the measured value is greater than the threshold value.

5. The electronic smoking device according to claim 2, wherein the control electronics are configured to utilise a default mode of operation to activate the heater if the measured value for the time interval or duration, respectively, has exceeded a predetermined threshold value.

6. The electronic smoking device according to claim 1, wherein the control electronics are configured to indicate the selection of a specific mode different from the previously used mode by an externally detectable acknowledgment signal.

7. The electronic smoking device according to claim 1, wherein the puff detector is configured to detect an over-pressure and the control electronics are responsive to detection of an over pressure by the puff detector to change the currently selected mode of operation for the heater.

8. The electronic smoking device according to claim 1, wherein the control electronics are configured to store data recording a history of activation of the puff detector and select a mode of operation to be utilised to activate the heater on the basis of the current detected manner of the activation of the puff detector and the stored data recording the history of activation of the puff detector.

9. The electronic smoking device according to claim 8 wherein the control electronics are configured to compare the current detected manner of the activation of the puff detector with one or more thresholds, wherein the thresholds are set on the basis of the stored data recording the history of activation of the puff detector.

10. The electronic smoking device according to claim 9 wherein the thresholds are set on the basis of the stored data recording the history of activation of the puff detector comprise thresholds relating to any of: the duration, frequency or extent of inhalation detected by the puff detector detecting a user sucking on the device.

11. The electronic smoking device according to claim 1, wherein at least one of the predetermined modes of operation is operable to create less aerosol during a puff than at least one of the other predetermined modes of operation.

12. The electronic smoking device according to claim 1, wherein the control electronics are configured to measure the time lapsed after the latest puff and to transfer the electronic smoking device into a dormant state, if this time exceeds a predetermined level.

13. A method for operating an electronic smoking device, comprising:

using control electronics of the device for detecting a predetermined sequence of sucking and/or blowing applied to the device by a user, the sequence corresponding to a specific mode of operation of the device;

using the control electronics for identifying the specific mode of operation of the device corresponding to the predetermined sequence; and using the control electronics for switching a heater of the device into the specific mode of operation identified, based on the detected predetermined sequence of sucking and/or blowing applied to the device by the user.

14. The electronic smoking device in accordance with claim 13 wherein the reservoir comprises a replaceable reservoir operable to be mounted and demounted from the atomizer.

15. The method of claim 13 wherein the control electronics identifies the specific mode of operation corresponding to the sequence by using a look-up table stored in the control electronics.

16. The electronic smoking device of claim 1 wherein the plurality of modes of operation includes a first mode wherein the atomizer generates a first amount of aerosol per puff, and a second mode wherein the atomizer generates a second amount of aerosol per puff, wherein the second amount is greater than the first amount.

17. A method of controlling an electronic smoking device, comprising:

sensing a user sucking on or blowing into the device;

detecting a characteristic of the sucking or blowing;

selecting a mode of operation from a plurality of modes of operation based on the characteristic detected via the sucking or blowing;

operating a heater of an atomizer based on the selected mode of operation, with two or more of the plurality of modes of operation operating the heater generating different volumes of aerosol.

18. The electronic smoking device of claim 1 wherein the mode selection is performed based only on the sucking on or blowing into the device, without using any interface element.

* * * * *